US011939176B2

(12) United States Patent
Kawaguchi

(10) Patent No.: US 11,939,176 B2
(45) Date of Patent: Mar. 26, 2024

(54) SHEET STORAGE DEVICE, IMAGE PROCESSING APPARATUS, AND CONTROL METHOD

(71) Applicant: TOSHIBA TEC KABUSHIKI KAISHA, Tokyo (JP)

(72) Inventor: Reo Kawaguchi, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 72 days.

(21) Appl. No.: 17/691,044

(22) Filed: Mar. 9, 2022

(65) Prior Publication Data

US 2023/0312276 A1 Oct. 5, 2023

(51) Int. Cl.
*B65H 1/18* (2006.01)
*B65H 1/08* (2006.01)

(52) U.S. Cl.
CPC ..... *B65H 1/08* (2013.01); *B65H 1/18* (2013.01); *B65H 2511/15* (2013.01); *B65H 2511/22* (2013.01); *B65H 2553/22* (2013.01); *B65H 2553/82* (2013.01)

(58) Field of Classification Search
CPC .. B65H 2511/15; B65H 1/18; B65H 2511/22; B65H 2553/22; B65H 1/08; B65H 2553/82
See application file for complete search history.

(56) References Cited

U.S. PATENT DOCUMENTS 8,953,955 B2 * 2/2015 Kogusuri ..... G03G 15/553 399/24
10,029,866 B2 * 7/2018 Harada ..... B65H 3/0661
2002/0135628 A1 9/2002 Kolodziej

* cited by examiner

*Primary Examiner* — Jeremy R Severson
(74) *Attorney, Agent, or Firm* — FOLEY & LARDNER LLP

(57) ABSTRACT

A sheet storage device includes a body, a tray, a rotating member, an angle sensor, and a controller. The tray is vertically repositionable relative to the body and supports a sheet placed on the tray. The rotating member rotates in conjunction with a vertical movement of the tray. The angle sensor detects a rotation angle of the rotating member. The controller is operatively coupled to the angle sensor and determines a remaining number of sheets placed on the tray based on a detection result of the angle sensor.

15 Claims, 7 Drawing Sheets

SHEET STORAGE DEVICE, IMAGE PROCESSING APPARATUS, AND CONTROL METHOD

FIELD

Embodiments described herein relate generally to a sheet storage device, an image processing apparatus, and a control method.

BACKGROUND

An image processing apparatus includes a sheet storage device that stores a plurality of sheets before processing. The sheet storage device specifies a remaining number of the stored sheets. However, there is room for improvement in an accuracy of specifying the remaining number of sheets.

DETAILED DESCRIPTION

In general, according to one embodiment, a sheet storage device is provided. The sheet storage device includes a body, a tray, a rotating member, an angle sensor, and a controller. The tray is vertically repositionable relative to the body and supports a sheet placed on the tray. The rotating member rotates in conjunction with a vertical movement of the tray. The angle sensor detects a rotation angle of the rotating member. The controller determines a remaining number of sheets placed on the tray based on a detection result of the angle sensor.

Hereinafter, a sheet storage device, an image processing apparatus, and a control method according to an embodiment will be described with reference to the drawings. An image processing apparatus 1 according to the present embodiment is an image forming apparatus such as a multifunction peripheral (MFP) printer or a copier. Hereinafter, an example in which the image processing apparatus 1 is an image forming apparatus as illustrated in FIG. 1 will be described.

EMBODIMENT

Figure 1:
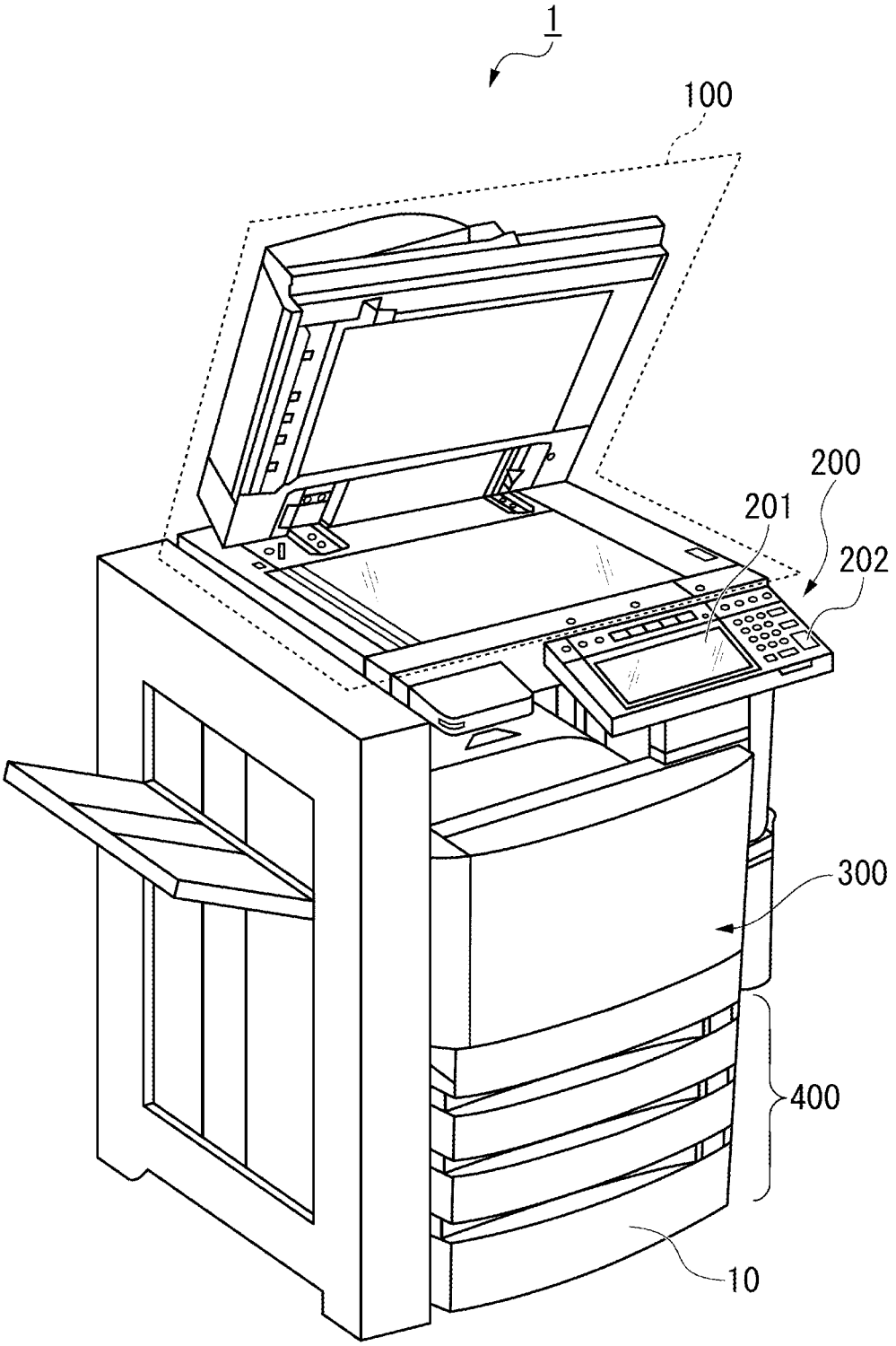
FIG. 1 is a perspective view illustrating an image processing apparatus according to an embodiment.
Figure 2:
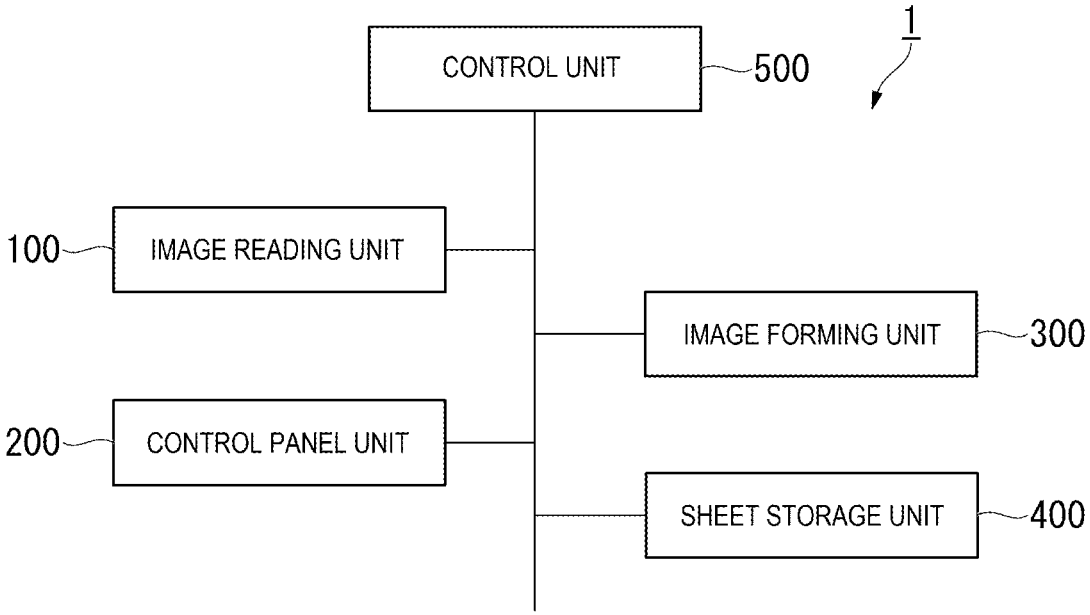
FIG. 2 is a block diagram illustrating a system configuration of the image processing apparatus.

FIG. 1 is a perspective view illustrating an image processing apparatus according to an embodiment. FIG. 2 is a block diagram illustrating a system configuration of the image processing apparatus according to the embodiment.

As illustrated in FIG. 1 and FIG. 2, an image processing apparatus 1 includes an image reading unit 100, a control panel unit 200, an image forming unit 300 (image processing unit), a sheet storage unit 400 (sheet storage device), and a control unit 500.

The image reading unit 100 (e.g., a scanner, a camera, etc.) converts characters and images printed on a sheet into electronic data.

The control panel unit 200 (e.g., a user interface) includes a display 201 (e.g., an output device) and a control panel 202 (e.g., an input device). The display 201 and the control panel 202 are used when a user operates the image processing apparatus 1. The display 201 is an image display device such as a liquid crystal display (LCD) or an organic electroluminescence (EL) display. The display 201 displays various kinds of information on the image processing apparatus 1. The control panel 202 receives inputs of various operation instructions.

The image forming unit 300 (e.g., a printer) forms an image on a sheet S. For example, the sheet S is a sheet of paper. The image forming unit 300 may be a device that fixes a toner image, or may be an inkjet device.

The sheet storage unit 400 (e.g., a storage portion, a storage area, a storage assembly, a sheet storage, etc.) stores the sheet S to be supplied to the image forming unit 300.

The control unit 500 (e.g., a controller) is a computer that controls the image reading unit 100, the control panel unit 200, the image forming unit 300, and the sheet storage unit 400. For example, the control unit 500 is a dedicated computer that controls the image processing apparatus 1. The control unit 500 may include a memory (e.g., a non-volatile memory) that stores instructions and a processor that executes the stored instructions to perform the functions described herein.

First Embodiment

Figure 3:
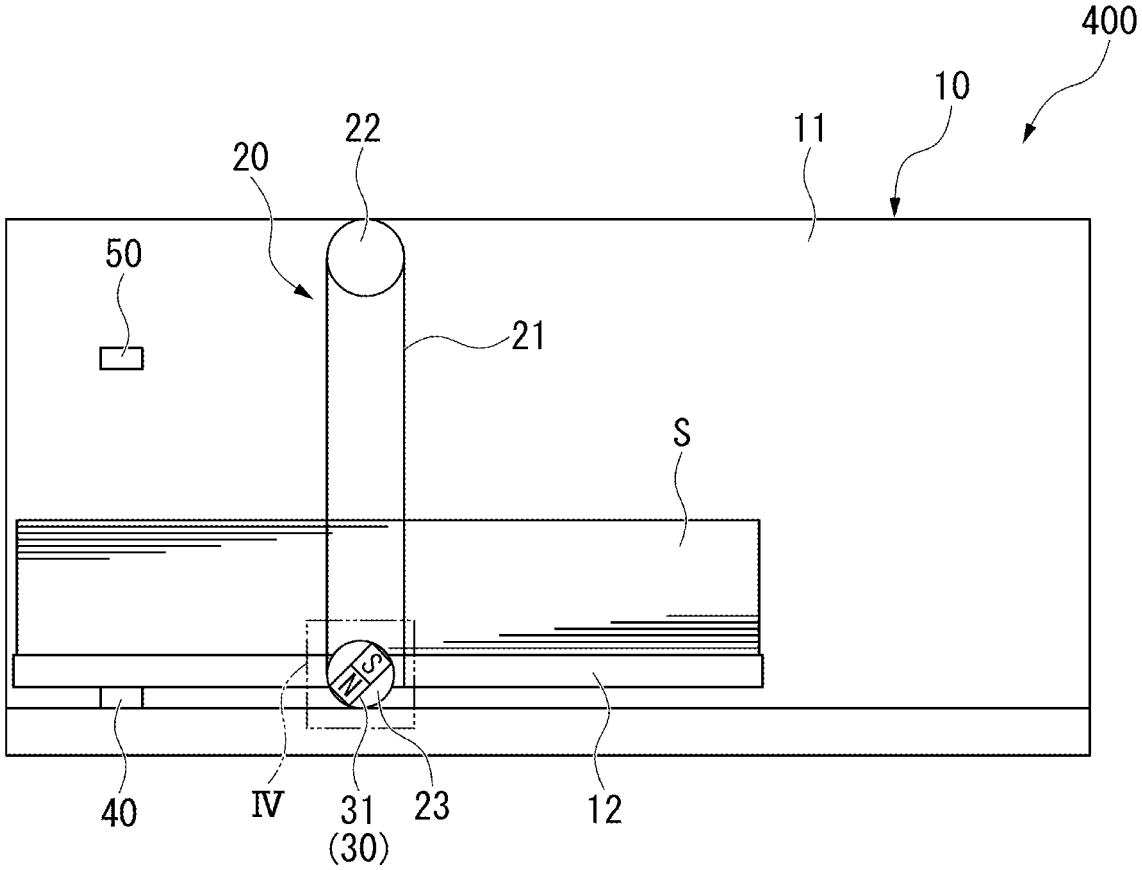
FIG. 3 is a front view illustrating a sheet storage unit according to a first embodiment.

The sheet storage unit 400 of a first embodiment will be described in detail. FIG. 3 is a front view illustrating a sheet storage unit according to the first embodiment. As illustrated in FIG. 3, the sheet storage unit 400 includes a sheet feed cassette 10.

The sheet feed cassette 10 stores a plurality of sheets S (e.g., arranged in a stack) to be supplied to the image forming unit 300. The sheet feed cassette 10 is stored in a housing of the image processing apparatus 1. The sheet feed cassette 10 can be pulled out from the housing of the image processing apparatus 1. Hereinafter, the plurality of sheets S stored in the sheet feed cassette 10 may be referred to as a sheet-bundle.

The sheet feed cassette 10 includes a cassette main body 11 (e.g., a drawer, a housing, a frame, a chassis, etc.), a tray 12 (e.g., a support portion), a drive unit 20 (e.g., a driver), an angle sensor 30, a tray sensor 40, and a sheet sensor 50.

The cassette main body 11 is slidably supported by the housing of the image processing apparatus 1. The cassette main body 11 is formed in a box shape that opens upward. The sheets S are disposed inside the cassette main body 11.

The tray 12 is disposed inside the cassette main body 11. The sheets S disposed inside the cassette main body 11 are placed on the tray 12. The tray 12 is formed so as to be vertically movable (e.g., vertically repositionable) with respect to the cassette main body 11 (e.g., the tray 12 is slidably coupled to the cassette main body 11). For example, the tray 12 is formed so as to be movable in parallel to a vertical direction. In this case, the tray 12 may be supported by a guide portion such as a rail or slide that allows only vertical movement with respect to the cassette main body 11. However, the tray 12 may be formed so as to be vertically movable (e.g., tiltable) so as to incline an upper surface. The tray 12 moves to a lowering end when the sheet feed cassette 10 is pulled out from the housing of the image processing apparatus 1 and the sheets S are added.

The drive unit 20 vertically moves the tray 12 with respect to the cassette main body 11. The drive unit 20 includes a wire 21 (e.g., a connecting member, a tensile member, a cable, a belt, a chain, etc.) coupled to the tray 12, a sheave 22 (e.g., an idler, a pulley, etc.) that suspends the wire 21 above the tray 12, a drum 23 (e.g., a rotating member) that winds the wire 21, and a drive source 24 that rotates the drum 23. A first end portion of the wire 21 is coupled to the tray 12. A second end portion of the wire 21 is coupled to the drum 23. The sheave 22 is a fixed pulley (e.g., a pulley with a fixed position that is free-spinning). The sheave 22 is disposed at a predetermined position with respect to the cassette main body 11. The sheave 22 suspends the wire 21 vertically above the first end portion of the wire 21. The drive source 24 generates power for vertically moving the tray 12. The drive source 24 is a motor (e.g., an electric motor). The drum 23 is coupled to an output shaft of the drive source 24. Accordingly, the drive source 24 constitutes a winch together with the drum 23. Further, the drum 23 may be connected to the output shaft of the drive source 24 via a power transmission mechanism (e.g., a transmission) such as a gear device (e.g., a gearbox) or a belt drive mechanism.

The tray 12 vertically moves so as to change a position in the vertical direction according to a winding amount of the wire 21 wound by the drum 23. In other words, as the drum 23 rotates, the wire 21 is wound around the drum 23 to vary a working length of the wire 21. As the working length decreases, the tray 12 moves upward, and as the working length increases, the tray 12 moves downward. The sheave 22 and the drum 23 rotate in conjunction with the vertical movement of the tray 12. In the present embodiment, the drum 23 rotates 360° or more in conjunction with the vertical movement of the tray 12. That is, the drum 23 rotates 360° or more while the tray 12 moves (e.g., throughout a range of motion) from one of the lowering end (e.g., a lowermost position, a lower end, etc.) and a raising end (e.g., an uppermost position, an upper end, etc.) to the other one.

Figure 4:
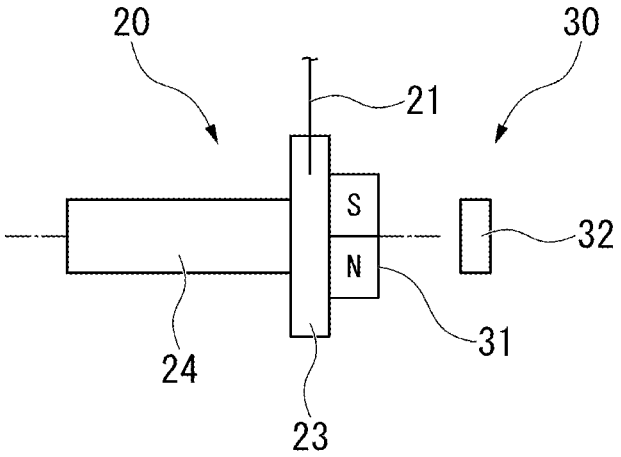
FIG. 4 is a side view illustrating detail section IV of FIG. 3.

FIG. 4 is a side view illustrating a detail section IV of FIG. 3. As illustrated in FIG. 3 and FIG. 4, the angle sensor 30 detects a rotation angle (e.g., an indication of an angular position) of the drum 23. The angle sensor 30 includes a magnet 31 fixed to the drum 23 and a detection unit 32 fixedly coupled to the cassette main body 11 so as to face the magnet 31. The magnet 31 rotates integrally with the drum 23. The magnet 31 is disposed such that a magnetic field of the magnet 31 is oriented in a direction orthogonal to an axial direction of the drum 23 (e.g., the north and south poles of the magnet 31 are radially offset from an axis of rotation of the drum 23). A direction of the magnetic field of the magnet 31 changes according to a rotation of the drum 23. The angle sensor 30 includes a plurality of (for example, four) magneto-resistance effect elements. For example, the magneto-resistance effect element is a tunnel magneto-resistance effect element. Each of the magneto-resistance effect elements outputs a detection signal corresponding to a change in the magnetic field of the magnet 31. The plurality of magneto-resistance effect elements output detection signals having phase differences from each other.

As illustrated in FIG. 3, the tray sensor 40 detects presence or absence of the tray 12 positioned at the lowering end. The tray sensor 40 is a contact sensor, an optical sensor, or the like.

The sheet sensor 50 detects the upper surface of the topmost sheet S placed on the tray 12 at a predetermined position in the vertical direction. The sheet sensor 50 is a contact sensor, an optical sensor, or the like. The sheet sensor 50 detects presence or absence of the upper surface of the sheet S at a position of the upper surface of the sheet-bundle having a predetermined upper limit number of sheets in a state where the tray 12 is positioned at the lowering end.

Figure 5:
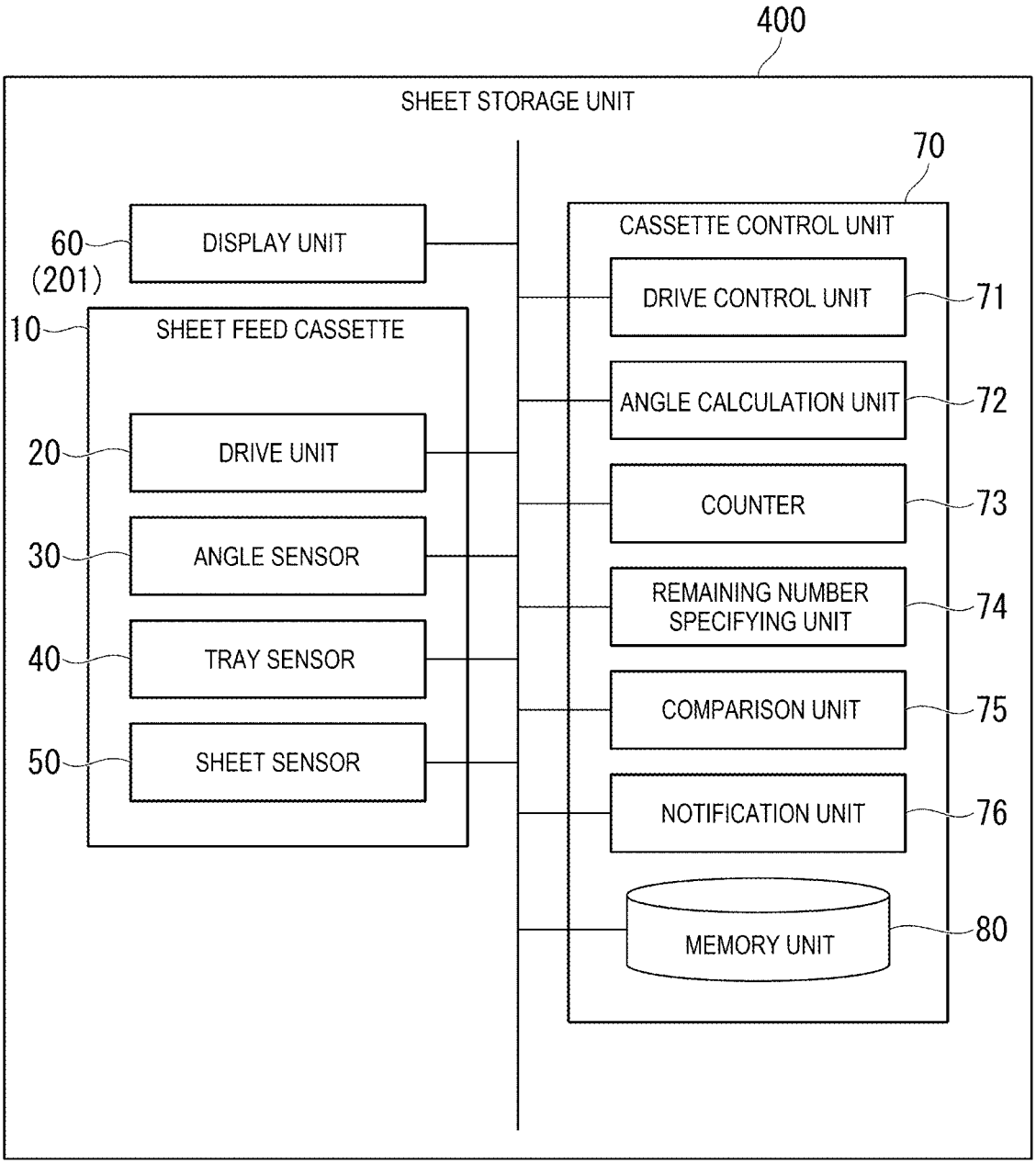
FIG. 5 is a block diagram illustrating a hardware configuration of the sheet storage unit.

FIG. 5 is a hardware configuration diagram of the sheet storage unit according to the first embodiment. As illustrated in FIG. 5, the sheet storage unit 400 further includes a display unit 60, a cassette control unit 70, and a memory unit 80. The display unit 60 is shared with the display 201. The cassette control unit 70 includes a part of the control unit 500 of the image processing apparatus 1. The cassette control unit 70 includes a drive control unit 71, an angle calculation unit 72, a counter 73, a remaining number specifying unit 74, a comparison unit 75, and a notification unit 76.

The drive control unit 71 controls the drive source 24.

The angle calculation unit 72 calculates, based on a detection value of the angle sensor 30, a rotation angle of the drum 23 with a state where the tray 12 is positioned at the lowering end as a reference (0°) within a range of 0° to 360°. The rotation angle of the drum 23 is set to increase as the tray 12 raises.

The counter 73 counts the number of rotations of the drum 23 with the state where the tray 12 is positioned at the lowering end as a reference. The counter 73 counts the number of times the rotation angle of the drum 23 calculated by the angle calculation unit 72 exceeds 360° (e.g., the number of full rotations of the drum 23).

The remaining number specifying unit 74 specifies a remaining number (e.g., quantity) of sheets S placed on the tray 12 based on the rotation angle of the drum 23 when the sheet sensor 50 detects the upper surface of the sheet S. The remaining number specifying unit 74 calculates, based on a calculated value of the angle calculation unit 72 and a value of the counter 73, a rotation angle of the drum 23 with the state where the tray 12 is positioned at the lowering end as a reference. The remaining number specifying unit 74 specifies the remaining number of sheets S with reference to a data table stored in the memory unit 80. The remaining number specifying unit 74 controls to display the specified remaining number of sheets S on the display unit 60.

The comparison unit 75 compares the number of sheets S to be supplied from the tray 12 to the image forming unit 300 with the remaining number of sheets S specified by the remaining number specifying unit 74. The comparison unit 75 specifies, based on a command from the control unit 500, the number of sheets S to be supplied from the sheet feed cassette 10 to the image forming unit 300 (e.g., to complete a print job or copy job).

The notification unit 76 notifies a shortage of the number of sheets S based on a comparison result of the comparison unit 75 (e.g., when the number of sheets S is insufficient to complete the print job or copy job). The notification unit 76 controls the display unit 60 and notifies the shortage of the number of sheets S. Note that a notification regarding the shortage of the number of sheets S may be a voice notification. For example, before the sheet S is supplied from the sheet feed cassette 10 to the image forming unit 300, the notification unit 76 notifies the shortage of the number of sheets S.

The memory unit 80 stores the data table in which information on the rotation angle of the drum 23 and information on the remaining number of sheets S are associated with each other. The information on the rotation angle of the drum 23 is the rotation angle of the drum 23 that rotates in a process of raising the tray 12 from the lowering end to the raising end with the state where the tray 12 is positioned at the lowering end as the reference (0°). Hereinafter, the rotation angle of the drum 23 when the tray 12 is positioned at the raising end is referred to as a maximum rotation angle. The information on the remaining number of sheets S is the number of sheets S placed on the tray 12.

Figure 6:
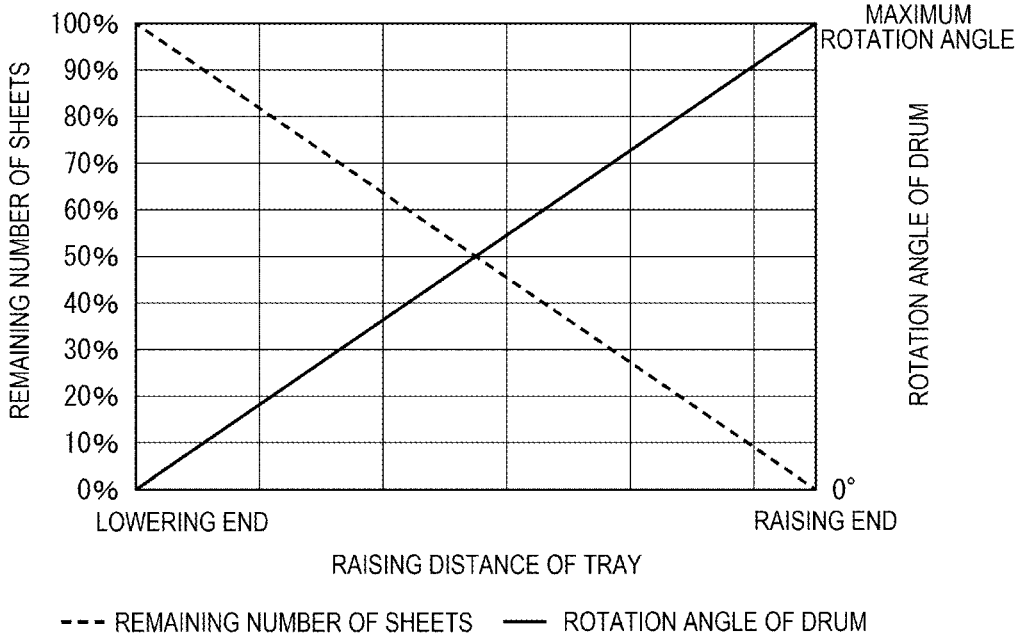
FIG. 6 is a graph illustrating a relation between a raising distance of a tray and a remaining number of sheets, and a relation between the raising distance of the tray and a rotation angle of a drum.

FIG. 6 is a graph illustrating a relation between a raising distance of a tray and a remaining number of sheets, and a relation between the raising distance of the tray and a rotation angle of a drum. A horizontal axis of the graph illustrated in FIG. 6 is a raising distance to the raising end with the lowering end of the tray 12 as a reference. A vertical axis on a left side of the graph illustrated in FIG. 6 is a ratio of the remaining number of sheets S placed on the tray 12 (e.g., as compared to when the tray 12 fully loaded with a predetermined number of sheets S or a maximum allowable number of sheets S). A vertical axis on a right side of the graph illustrated in FIG. 6 is the rotation angle of the drum 23.

As illustrated in FIG. 6, the rotation angle of the drum 23 is proportional to the raising distance of the tray 12. The remaining number of sheets S is proportional to the distance to the raising end of the tray 12. Based on the relations illustrated in FIG. 6, the data table stored in the memory unit 80 is set. In the data table, the number of sheets S when the rotation angle of the drum 23 is 0° is the predetermined upper limit number of sheets placed on the tray 12 positioned at the lowering end. In the data table, the number of sheets S when the rotation angle of the drum 23 is the maximum rotation angle is 0.

Figure 7:
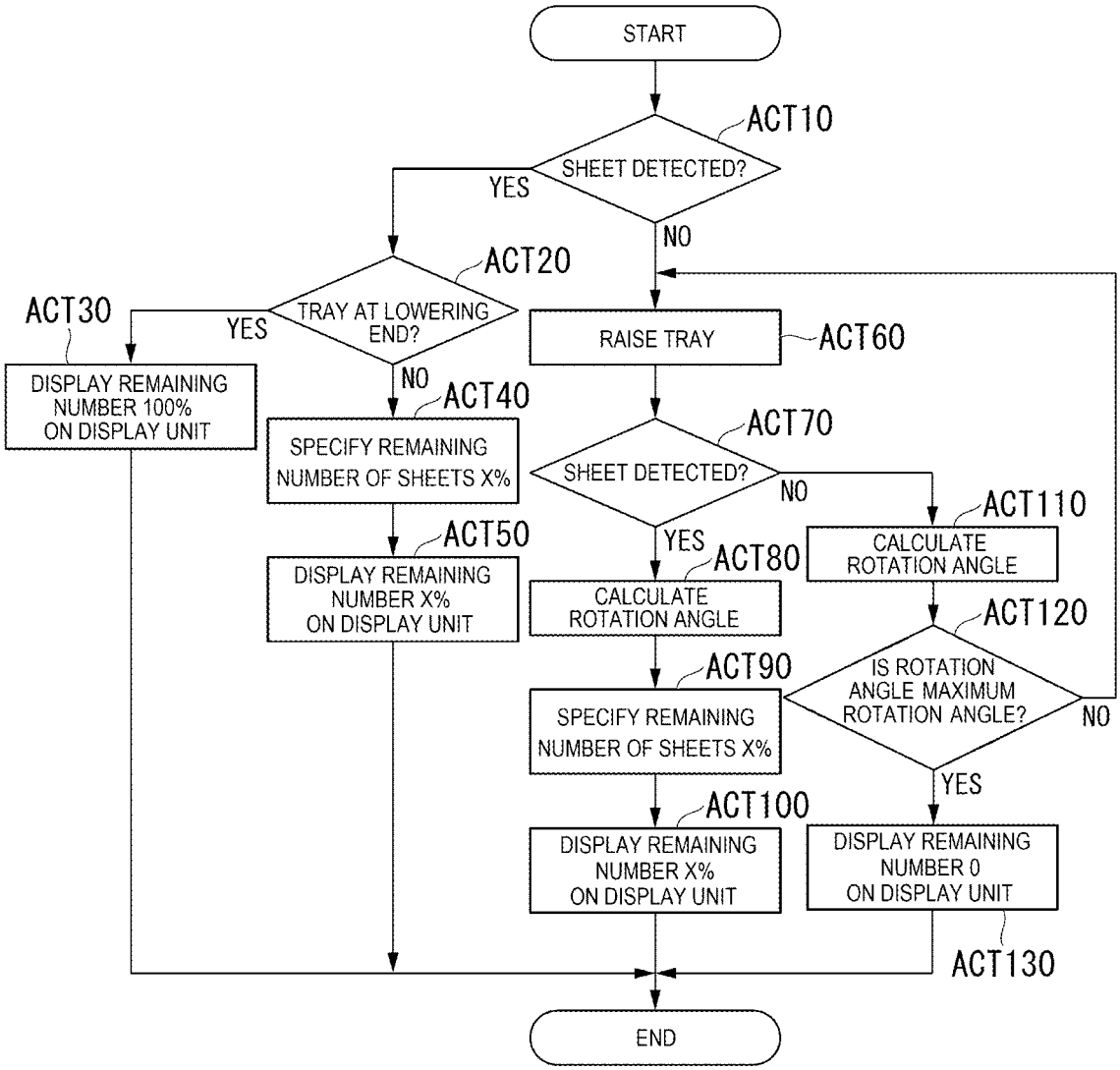
FIG. 7 is a flowchart illustrating an operation example of the sheet storage unit.

Next, a processing flow of the sheet storage unit 400 of the present embodiment will be described. FIG. 7 is a flowchart illustrating an operation example of the sheet storage unit of the first embodiment. For example, an operation flow illustrated in FIG. 7 is executed when the sheet feed cassette 10 is opened or closed or when the image processing apparatus 1 is activated.

The remaining number specifying unit 74 determines whether the sheet sensor 50 detects the sheet S placed on the tray 12 (ACT 10). When the sheet sensor 50 detects the sheet S (YES in ACT 10), the remaining number specifying unit 74 determines whether the tray sensor 40 detects the tray 12 (ACT 20). That is, the remaining number specifying unit 74 determines whether the tray 12 is positioned at the lowering end. When it is determined that the tray 12 is positioned at the lowering end (YES in ACT 20), the remaining number specifying unit 74 specifies that the predetermined upper limit number of sheets S are placed on the tray 12. In this case, the remaining number specifying unit 74 may specify the remaining number of sheets S with reference to the data table stored in the memory unit 80. The remaining number specifying unit 74 causes the display unit 60 to display that the remaining number of sheets S is 100% (ACT and a series of processing ends.

When it is determined that the tray 12 is not positioned at the lowering end (NO in ACT 20), the remaining number specifying unit 74 specifies a ratio of the remaining number of sheets S (ACT Specifically, the remaining number specifying unit 74 specifies a ratio of the remaining number of sheets S based on a ratio of the rotation angle of the drum 23 to the maximum rotation angle of the drum 23. In the present embodiment, the remaining number specifying unit 74 specifies a remaining number of sheets S with reference to the data table stored in the memory unit 80. Then, the remaining number specifying unit 74 causes the display unit 60 to display the specified remaining number of sheets S (ACT 50), and a series of processing ends.

On the other hand, when the sheet sensor 50 does not detect the sheet S (NO in ACT 10), the drive control unit 71 raises the tray 12 by a predetermined distance (ACT 60). Then, the remaining number specifying unit 74 determines whether the sheet sensor 50 detects the sheet S placed on the tray 12 (ACT 70). When the sheet sensor 50 detects the sheet S (YES in ACT 70), the remaining number specifying unit 74 calculates a rotation angle of the drum 23 (ACT 80). The remaining number specifying unit 74 specifies a ratio of the remaining number of sheets S based on a ratio of the rotation angle of the drum 23 to the maximum rotation angle of the drum 23 (ACT 90). In the present embodiment, the remaining number specifying unit 74 specifies a remaining number of sheets S with reference to the data table stored in the memory unit 80.

Then, the remaining number specifying unit 74 causes the display unit 60 to display the specified remaining number of sheets S (ACT 100), and a series of processing ends.

When the sheet sensor 50 does not detect the sheet S (NO in ACT 70), the remaining number specifying unit 74 calculates a rotation angle of the drum 23 (ACT 110). Subsequently, the remaining number specifying unit 74 determines whether the calculated rotation angle of the drum 23 matches the maximum rotation angle of the drum 23 (ACT 120). When the rotation angle of the drum 23 does not match the maximum rotation angle of the drum 23 (NO in ACT 120), the tray 12 is positioned below the raising end. Therefore, the drive control unit 71 again raises the tray 12 by a predetermined distance (ACT 60). When the rotation angle of the drum 23 matches the maximum rotation angle of the drum 23 (YES in ACT 120), the sheet S is not placed on the tray 12. Therefore, the remaining number specifying unit 74 causes the display unit 60 to display that there is no sheet S (ACT 130), and a series of processing ends.

As described above, the image processing apparatus 1 of the present embodiment includes: the drum 23 that rotates in conjunction with the vertical movement of the tray 12; the angle sensor 30 that detects the rotation angle of the drum 23; and the remaining number specifying unit 74 that specifies the remaining number of sheets S placed on the tray 12 based on the detection result of the angle sensor 30. According to this configuration, a vertical movement distance of the tray 12 can be accurately specified as compared with the configuration in which the remaining number of sheets placed on the tray is specified based on a vertical movement time of the tray. Therefore, the image processing apparatus 1 can improve an accuracy of specifying the remaining number of the stored sheets S based on the vertical movement distance of the tray 12.

The remaining number specifying unit 74 specifies a remaining number of sheets based on a rotation angle of the drum 23 when the tray 12 is displaced between a state where the tray 12 positioned at the lowering end is detected by the tray sensor 40 and a state where the upper surface of the sheet S is detected by the sheet sensor 50. According to this configuration, a distance between the upper surface of the sheet-bundle placed on the tray 12 and a position detected by the sheet sensor 50 can be detected. Accordingly, a difference between the position of the upper surface of the sheet-bundle having the predetermined upper limit number of sheets and the position of the upper surface of the sheet-bundle placed on the tray 12 can be calculated.

Therefore, the remaining number of the stored sheets S can be specified.

The image processing apparatus 1 includes the display unit 60 that displays the remaining number of sheets S specified by the remaining number specifying unit 74. According to this configuration, the remaining number of sheets S can be recognized by the user.

The image processing apparatus 1 includes the comparison unit 75 and the notification unit 76. The comparison unit 75 compares the number of sheets S to be supplied from the tray 12 with the remaining number of sheets S specified by the remaining number specifying unit 74. The notification unit 76 notifies the shortage of the number of sheets S based on the comparison result of the comparison unit 75. According to this configuration, the user can recognize the sheet shortage before the sheet S is discharged from the tray 12. Accordingly, it is possible to prevent the processing on the sheet S supplied from the tray 12 from being interrupted due to the sheet shortage.

The angle sensor 30 includes the magnet 31 that rotates integrally with the drum 23, and the plurality of magneto-resistance effect elements that output a detection signal corresponding to a change in a magnetic field caused by the rotation of the magnet 31. The plurality of magneto-resistance effect elements output detection signals having phase differences from each other. According to this configuration, the angle sensor 30 can output a detection signal corresponding to an absolute angle within the range of 0° to 360° as the rotation angle of the drum 23. That is, it is possible to avoid the specified detection signal output by the angle sensor 30 corresponding to a plurality of rotation angles of the drum 23 within a range of 0° to 360°. Therefore, the detection value of the angle sensor 30 and the remaining number of the sheets S can be easily associated with each other.

Second Embodiment

A sheet storage unit 400A according to a second embodiment will be described in detail. The second embodiment is different from the first embodiment in that the angle sensor 30 detects a rotation angle of a rotation body 90 provided separately from the drive unit 20.

Figure 8:
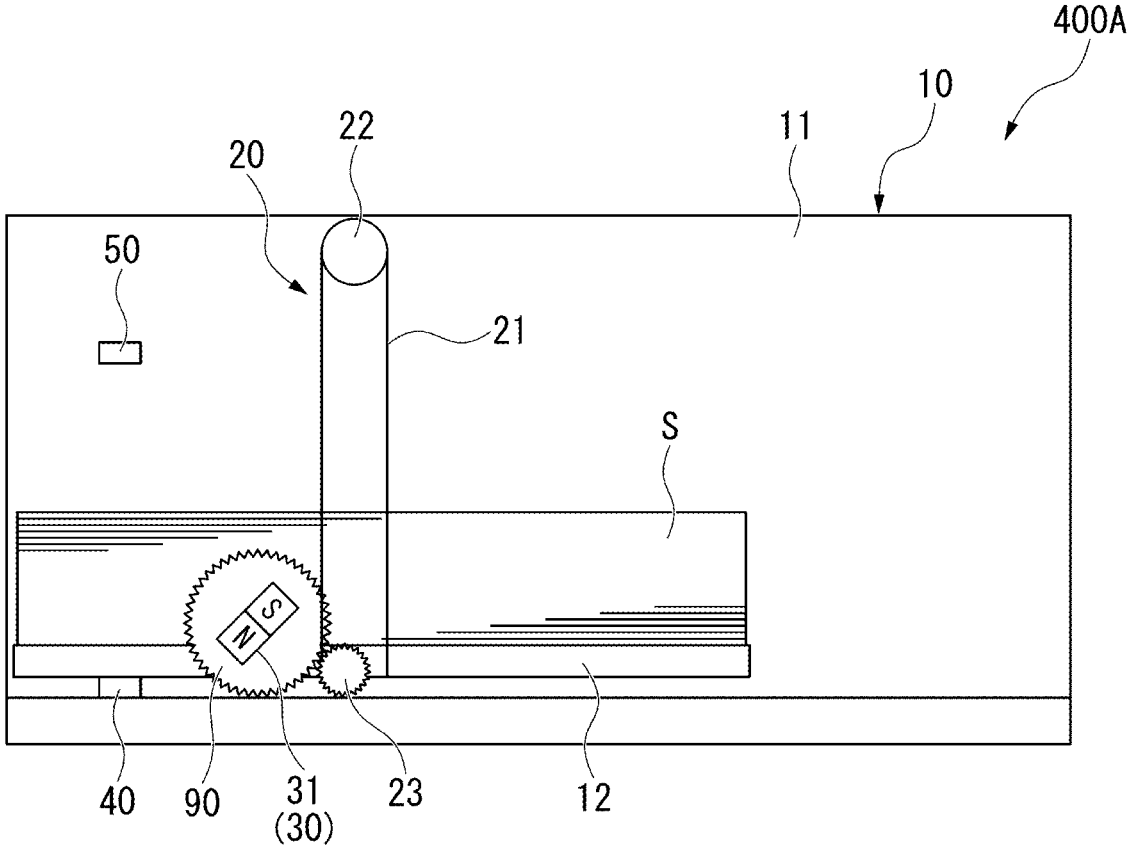
FIG. 8 is a front view illustrating a sheet storage unit according to a second embodiment.

FIG. 8 is a front view illustrating a sheet storage unit according to the second embodiment. As illustrated in FIG. 8, the sheet storage unit 400A includes the rotation body 90 that rotates in conjunction with an operation of the drive unit 20. The rotation body 90 is directly engaged with the drum 23 and rotates integrally with the drum 23. In the present embodiment, the drum 23 and the rotation body 90 have a gear structure that meshes with each other (e.g., the drum 23 and the rotation body 90 have corresponding gear teeth that engage one another to limit or prevent rotation relative to one another, such that the drum 23 and the rotation body 90 are in rotational engagement with one another). The rotation body 90 synchronously rotates with the drum 23 in conjunction with the vertical movement of the tray 12. The rotation body 90 rotates less than 360° in conjunction with the vertical movement of the tray 12. That is, the rotation body 90 rotates by less than 360° while the tray 12 moves from one of the lowering end and the raising end to the other one.

The angle sensor 30 detects the rotation angle of the rotation body 90. The magnet 31 of the angle sensor 30 is fixed to the rotation body 90. The magnet 31 rotates integrally with the rotation body 90. The magnet 31 is disposed such that a magnetic field is oriented in a direction orthogonal to an axial direction of the rotation body 90. A direction of the magnetic field of the magnet 31 changes according to a rotation of the rotation body 90.

In the present embodiment, the rotation body 90 rotates less than 360° in conjunction with the vertical movement of the tray 12. According to this configuration, the detection value of the angle sensor 30 can be associated with the rotation angle of the drum 23 on a one-to-one basis. Accordingly, the remaining number specifying unit 74 can calculate the rotation angle of the drum 23 without using a value of the counter 73. Therefore, the detection value of the angle sensor 30 and the remaining number of sheets S can be easily associated with each other.

Although the drum 23 rotates 360° or more in conjunction with the vertical movement of the tray 12 in the first embodiment, the present disclosure is not limited to this configuration. A drum may rotate less than 360° in conjunction with the vertical movement of the tray 12. In this case, the same functions and effects as those of the second embodiment are obtained.

Although the magnet 31 of the angle sensor 30 is fixed to the drum 23 of the drive unit 20 in the first embodiment, the present disclosure is not limited to this configuration. A magnet of an angle sensor may be fixed to a rotation body that rotates in conjunction with the vertical movement of the tray 12, and may be fixed to, for example, the sheave 22 of the drive unit 20.

Although the rotation body 90 has a gear structure in which the rotation body 90 meshes with the drum 23 in the second embodiment, the present disclosure is not limited to this configuration. A rotation body may rotate in conjunction with the operation of the drive unit 20, for example, the rotation body may be connected to the drum 23 via a power transmission mechanism such as a belt drive mechanism.

Although the drive unit 20 includes the wire 21 coupled to the tray 12 in the above-described embodiments, the present disclosure is not limited to this configuration. A drive unit may include a belt, a chain, or another tensile member instead of a wire. The drive unit may be a rack-and-pinion mechanism. In this case, by fixing the magnet of the angle sensor to the rotation body such as a pinion, the above-described functions and effects are obtained. Further, the drive unit may be a belt drive mechanism including a pulley and a belt. In this case, by fixing the magnet of the angle sensor to the rotation body such as the pulley, the above-described functions and effects are obtained.

Although the remaining number specifying unit 74 specifies the remaining number of sheets S with reference to the data table stored in the memory unit 80 in the above-described embodiments, the present disclosure is not limited to this configuration. That is, a remaining number specifying unit may calculate a remaining number of sheets S based on the calculated rotation angle of the drum 23, the predetermined upper limit number of sheets S set in advance, and the maximum rotation angle of the drum 23.

According to at least one of the embodiments described above, the remaining number of sheets is specified based on the rotation angle of the rotation body that rotates in conjunction with the vertical movement of the tray. Therefore, it is possible to improve an accuracy of specifying the remaining number of the stored sheets based on the vertical movement distance of the tray.

While certain embodiments have been described these embodiments have been presented by way of example only, and are not intended to limit the scope of the inventions. Indeed, the novel embodiments described herein may be embodied in a variety of other forms; furthermore, various omissions, substitutions, and changes in the form of the embodiments described herein may be made without departing from the spirit of the inventions. The accompanying claims and their equivalents are intended to cover such forms or modifications as would fall within the scope and spirit of the invention.

What is claimed is:

1. A sheet storage device comprising:

a body;

a tray vertically repositionable relative to the body and configured to support a sheet placed on the tray;

a drum configured to rotate in conjunction with a vertical movement of the tray;

a wire at least partially wrapped around the drum such that a working length of the wire between the drum and the tray varies as the drum rotates, the wire coupling the drum to the tray, and the wire being configured to cause the vertical movement of the tray in response to a rotation of the rotating member;

an angle sensor configured to detect a rotation angle of the drum; and a controller operatively coupled to the angle sensor and configured to determine a remaining number of sheets placed on the tray based on a detection result of the angle sensor.

2. The sheet storage device of claim 1, further comprising:

a tray sensor operatively coupled to the controller and configured to detect when the tray is positioned at a lower end of a range of motion of the tray; and a sheet sensor operatively coupled to the controller and configured to detect when an upper surface of the sheet placed on the tray is positioned at a predetermined position in a vertical direction, wherein the controller is configured to determine the remaining number of sheets based on the rotation angle of the drum when the tray is displaced between a state where the tray is detected by the tray sensor and a state where the sheet is detected by the sheet sensor.

3. The sheet storage device of claim 2, wherein:

the tray is configured to support a stack of sheets placed on the tray;

the sheet is a topmost sheet of the stack of sheets placed on the tray; and the sheet sensor is positioned to detect when the upper surface of the topmost sheet is positioned at the predetermined position.

4. The sheet storage device of claim 1, wherein the drum is configured to rotate less than 360° in conjunction with the vertical movement of the tray.

5. The sheet storage device of claim 1, further comprising:

a display operatively coupled to the controller and configured to display the remaining number of sheets determined by the controller.

6. The sheet storage device of claim 1, wherein the controller is configured to:

compare a number of sheets to be supplied from the tray with the remaining number of sheets determined by the controller; and provide a notification to a user in response to a determination that the remaining number of sheets is less than the number of sheets to be supplied from the tray.

7. The sheet storage device of claim 1, wherein the wire passes through a sheave between the drum and the tray, the sheave having a fixed position relative to the body.

8. A sheet storage device comprising:

a body;

a tray vertically repositionable relative to the body and configured to support a sheet placed on the tray;

a rotating member configured to rotate in conjunction with a vertical movement of the tray;

an angle sensor configured to detect a rotation angle of the rotating member, the angle sensor including a magnet configured to rotate with the rotating member, and a plurality of magneto-resistance effect elements configured to output detection signals corresponding to a change in a magnetic field caused by a rotation of the magnet; and a controller operatively coupled to the angle sensor and configured to determine a remaining number of sheets placed on the tray based on a detection result of the angle sensor, wherein the plurality of magneto-resistance effect elements are configured to output detection signals having phase differences from each other.

9. The sheet storage device of claim 8, wherein the magnet is directly and fixedly coupled to the rotating member.

10. The sheet storage device of claim 8, further comprising a gear in rotational engagement with the rotating member, wherein the magnet is directly and fixedly coupled to the gear.

11. A control method for a sheet storage device including a tray on which at least one sheet is placed, the control method comprising:

detecting, by a rotation sensor, a rotation angle of a rotating member that rotates in conjunction with a vertical movement of the tray;

detecting, by a tray sensor, that the tray is positioned at a lowermost position of the tray;

detecting, by a sheet sensor, that an upper surface of the at least one sheet has reached a predetermined vertical position; and determining, based on the detected rotation angle of the rotating member, a remaining number of sheets placed on the tray.

12. The control method of claim 11, further comprising:

displaying the determined remaining number of sheets on a display.

13. The control method of claim 11, further comprising:

providing a notification indicating a sheet shortage in response to a determination that a number of sheets to be supplied from the tray is greater than the determined remaining number of sheets.

14. The control method of claim 11, further comprising:

determining that the remaining number of sheets is a maximum allowable number of sheets in response to a determination that the upper surface of the at least one sheet is in the predetermined vertical position when the tray is in the lowermost position.

15. The control method of claim 11, further comprising:

raising, by a motor, the tray until the sheet sensor indicates that the upper surface of the at least one sheet has reached the predetermined vertical position, wherein determining the remaining number of sheets includes determining, based on the detected rotation angle of the rotating member when the upper surface of the at least one sheet is in the predetermined vertical position, the remaining number of sheets placed on the tray.

* * * * *